US010818446B2

(12) United States Patent
Askan

(10) Patent No.: US 10,818,446 B2
(45) Date of Patent: Oct. 27, 2020

(54) DEVICE TO ATTENUATE ARC FAULTS IN AN ELECTRIC DISTRIBUTOR

(71) Applicant: Eaton Intelligent Power Limited, Dublin 4 (IE)

(72) Inventor: Kenan Askan, Vienna (AT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 159 days.

(21) Appl. No.: 16/192,824

(22) Filed: Nov. 16, 2018

(65) Prior Publication Data

US 2019/0157856 A1 May 23, 2019

(30) Foreign Application Priority Data

Nov. 17, 2017 (DE) ..... 10 2017 127 133

(51) Int. Cl.
*H01H 9/54* (2006.01)
*H01H 47/32* (2006.01)
*H01H 9/00* (2006.01)

(52) U.S. Cl.
CPC ..... *H01H 9/542* (2013.01); *H01H 9/0066* (2013.01); *H01H 9/547* (2013.01); *H01H 47/32* (2013.01); *H01H 2009/543* (2013.01); *H01H 2009/544* (2013.01)

(58) Field of Classification Search
CPC ..... H01H 9/542; H01H 9/547; H01H 47/32; H01H 2009/543; H01H 2009/544; H01H 9/0066; H02H 3/105
See application file for complete search history.

(56) References Cited

U.S. PATENT DOCUMENTS 5,381,297 A 1/1995 Weber
7,479,858 B1 1/2009 Baurand et al.
8,614,866 B2 * 12/2013 Billingsley ..... H01H 9/56 361/8
8,988,844 B2 3/2015 Braun et al.
(Continued)

FOREIGN PATENT DOCUMENTS

CN 1125494 A 6/1996
CN 1378699 A 11/2002
(Continued)

*Primary Examiner* — Fred E Finch, III
*Assistant Examiner* — Rafael O De Leon Domenech
(74) *Attorney, Agent, or Firm* — Leydig, Voit & Mayer, Ltd.

(57) ABSTRACT

A hybrid circuit configuration, particularly a protection circuit configuration, includes: at least one first external conductor segment; a first mechanical bypass switch in the first external conductor segment; a first semiconductor switch configuration connected in parallel to the first bypass switch; a first electronic control unit for activating the first semiconductor switch configuration; and a bypass switch activation unit, to which bypass switch activation unit at least one field coil of the bypass switch is connected. At least one control terminal of the bypass switch activation unit is connected to the first electronic control unit. The electronic control unit and/or the bypass switch activation unit controls the at least one field coil of the bypass switch in a preconfigured way either with at least one first electric current or one second electric current, the one second electric current being greater than the at least one first electric current.

9 Claims, 2 Drawing Sheets

(56) References Cited

U.S. PATENT DOCUMENTS

| | | | | |
|---|---|---|---|---|
| 10,170,258 | B2 | 1/2019 | Fulcheri | |
| 2003/0193770 | A1* | 10/2003 | Chung | H01H 9/542 361/118 |
| 2013/0154774 | A1* | 6/2013 | Bhavaraju | H01H 47/32 335/127 |
| 2016/0203932 | A1* | 7/2016 | Niehoff | H01H 47/32 361/170 |
| 2016/0301200 | A1* | 10/2016 | Niehoff | H02H 3/08 |
| 2016/0301204 | A1* | 10/2016 | Niehoff | H02H 1/06 |
| 2016/0314928 | A1* | 10/2016 | Niehoff | H01H 83/04 |

FOREIGN PATENT DOCUMENTS

| | | | |
|---|---|---|---|
| DE | 3702680 | A1 | 10/1987 |
| DE | 102015120351 | A1 | 11/2016 |
| EP | 1956622 | A2 | 8/2008 |
| WO | WO 2012084002 | A1 | 6/2012 |
| WO | WO 2015028634 | A1 | 3/2015 |

* cited by examiner

DEVICE TO ATTENUATE ARC FAULTS IN AN ELECTRIC DISTRIBUTOR

CROSS-REFERENCE TO PRIOR APPLICATION

Priority is claimed to German Patent Application No. DE 10 2017 127 133.3, filed on Nov. 17, 2017, the entire disclosure of which is hereby incorporated by reference herein.

FIELD

This invention concerns a hybrid circuit configuration.

BACKGROUND

Hybrid circuit configurations are known. These are control units or circuit configurations that feature both mechanical switching contacts and semiconductor switches to interrupt or generate a current path through the concerned circuit configuration. When powering down, a mechanical switch, often known as a bypass switch, is first opened, whereupon the current commutates through the circuit configuration to the semiconductor switches, which then switches off the current.

The so-called bypass switch occupies a central position in this because it is constantly in the current flow whose internal resistance is highly relevant for keeping the permanent power dissipation and self-heating of the circuit configuration to a minimum. The internal resistance is substantially determined by the type and condition of the switching contacts of the bypass switch and the contact pressure.

When powering down a very strong current, as occurs, for example, in a short circuit, it is necessary for the contacts of the bypass switch to open as quickly as possible to achieve commutation of a current of the art to the semiconductor switches as quickly as possible. In such case, contact opening times of a few hundred microseconds are necessary or possible. This not only creates high demands on the contact device of the bypass switch, but also requires a correspondingly strong impulse. The resulting high accelerations lead to high power and high mechanical stress on the bypass switch.

It has been shown that hybrid circuit configurations that feature correspondingly fast bypass switches to power down very strong currents, such as short circuit currents in low-voltage uses, in particular, can only perform a limited number of shutdowns before the deteriorated contact situation at the bypass switch or the high mechanical stress on the bypass switch leads to an outage or the loss of reliability of the circuit configuration when powering down quickly.

As a protection switch, the concerned hybrid circuit configuration must only perform a few shutdowns for many years. However, appropriate switching requires the switching of limited currents for at least 100,000 cycles of operation.

Known hybrid circuit configurations of the art are thus appropriate as protection switches or as a switch for operational switching, but not to perform both tasks, thus to switch an electric consumer "on" and "off" and also to protect the same from short circuits or overcurrents.

SUMMARY

In an embodiment, the present invention provides a hybrid circuit configuration, particularly a protection circuit configuration, comprising: at least one first external conductor segment; a first mechanical bypass switch provided in the first external conductor segment; a first semiconductor switch configuration connected in parallel to the first bypass switch; a first electronic control unit configured to activate the first semiconductor switch configuration; and a bypass switch activation unit, to which bypass switch activation unit at least one field coil of the bypass switch is connected, wherein at least one control terminal of the bypass switch activation unit is connected to the first electronic control unit, and wherein the electronic control unit and/or the bypass switch activation unit is configured to control the at least one field coil of the bypass switch in a preconfigured way either with at least one first electric current or one second electric current, the one second electric current being greater than the at least one first electric current.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

In an embodiment, the present invention provides a hybrid circuit configuration of the art named at the onset, with which the mentioned disadvantages can be avoided and with which electrical load can be appropriately switched over a long period of time as well as protected against overcurrents and short circuits.

An electrical load can therefore be appropriately switched over a long period of time as well as protected against overcurrents and short circuits. Through the physical provisions, a bypass relay or a bypass switch can be operated with limited energy in all situations in which a particularly rapid opening of the concerned switch contacts is not necessary and thus during the frequent powering on and powering down during operations. This leads to a slower contact opening and less stress on the bypass switch. Since less energy must be generated for this as a result, plans can also be made for a correspondingly smaller power supply with less power dissipation. In case of a rare electrical error, the bypass switch is provided with correspondingly high or great energy, which leads to rapid opening of the switch contacts and quick commutation of the current to the first semiconductor switch. A hybrid circuit configuration of the art features a long lifetime.

Figure 1:
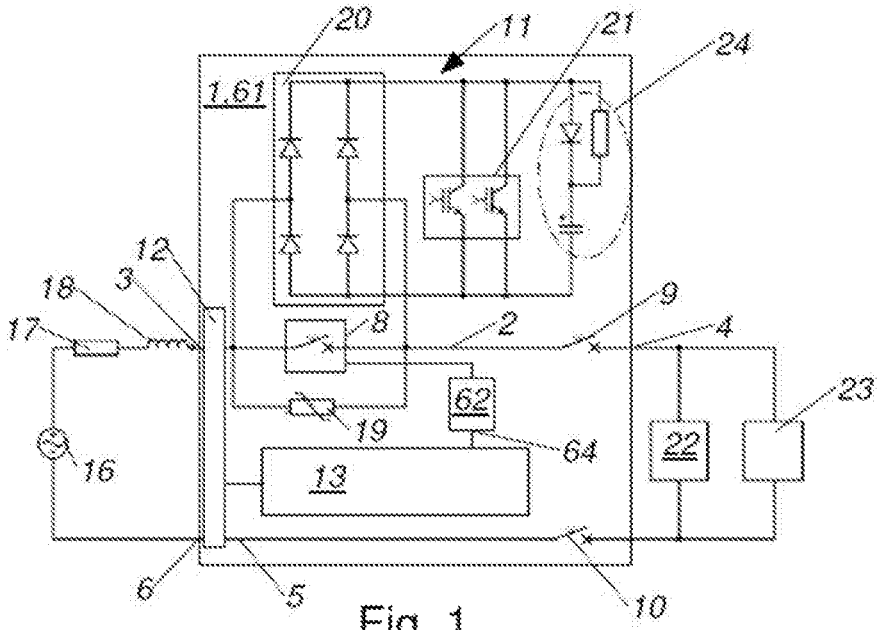
Fig. 1 Prior Art
FIG. 1: a physical low-voltage protective switch device with a physical hybrid circuit configuration.

FIG. 1 shows a block diagram of a low-voltage protective switch device 1 with a hybrid circuit configuration 61, in particular a protection circuit configuration, comprising at least one first external conductor segment 2, wherein a first mechanical bypass switch 8 is configured in the first external conductor segment 2, wherein a first semiconductor switch configuration 11 is connected parallel to the first bypass switch 8, wherein the hybrid circuit configuration 61 features a first electronic control unit 13 to activate the first semiconductor switch configuration 11, wherein the hybrid 61 features a bypass switch activation unit 62, to which bypass switch activation unit 62 at least one field coil 63 of the bypass switch 8 is connected, and wherein at least one control terminal 64 of the bypass switch activation unit 62 is connected to the first electronic control unit 13, wherein the electronic control unit 13 and/or the bypass switch activation unit 62 is designed to control the field coil 63 of the bypass switch 8 in a preconfigured way either with at least one first electric current or one second electric current, wherein the second electric current is greater than the first electric current.

An electrical load 23 can therefore be appropriately switched over a long period of time as well as protected against overcurrents and short circuits. Through the physical provisions, a bypass relay or a bypass switch 8 can be operated with limited energy in all situations in which a particularly rapid opening of the concerned switch contacts is not necessary and thus during the frequent powering on and powering down during operations. This leads to a slower contact opening and less stress on the bypass switch 8. Since less energy must be generated for this as a result, plans can also be made for a correspondingly smaller power supply 68 with less power dissipation. In case of a rare electrical error 22, the bypass switch 8 is provided with correspondingly high or great energy, which leads to rapid opening of the switch contacts and quick commutation of the current to the first semiconductor switch 21. A hybrid circuit configuration 61 of the art features a long lifetime.

The concept of a hybrid circuit configuration 61 as well as a low-voltage protective switch device 1 with a hybrid circuit configuration 61 of the art is known from WO 2015/028634 A1. The physical hybrid circuit configuration 61 is also designed for low voltage. Low voltage is, as usual in this field, considered to be up to 1000V AC or 1500V DC.

FIG. 1 shows a low-voltage protective switch device 1 with a physical hybrid circuit configuration 61, as described according to the concept and up to the design of the electronic control unit 13 and/or the bypass switch activation unit 62 in WO 2015/028634 A1. This features at least one external conductor segment 2 as well as a neutral conductor segment 5. The external conductor segment 2 runs through the low-voltage protective switch device 1 from an external conductor supply unit 3 to an external conductor load connection 4. The neutral conductor segment 5 runs through the low-voltage protective switch device 1 from a neutral conductor connection 6 to a neutral conductor load connection 7. The concerned connections 3, 4, 6, 7 are each preferably depicted as screw terminal blocks or plug terminal blocks and configured in a low-voltage protective switch device 1 to be accessible from the outside.

The low-voltage protective switch device 1 preferably features an insulated material case.

The external conductor segment 2 is configured on the mechanical bypass switch 8.

In the low-voltage protective switch device 1, as illustrated, in the external conductor segment 2, a first mechanical isolator 9 is also preferably serially configured on the bypass switch 8. In the neutral conductor segment 5, a second mechanical isolator 10 is preferably configured. A semiconductor circuit configuration 11 is connected parallel to the bypass switch 8.

A surge arrestor 19 is also connected parallel to the bypass switch 8.

The low-voltage protective switch device 1 moreover features a current measurement unit 12, which is configured in the external conductor segment 2, and which is preferably designed to comprise a shunt resistor.

The current measurement unit 12 is connected to an electronic control unit 13 of the low-voltage protective switch device 1, which is preferably designed to comprise a microcontroller or microprocessor. The electronic control unit 13 is designed to control the bypass switch 8 and the first semiconductor switch configuration 11, as well as the preferably provided first mechanical isolator 9 and the preferably provided second mechanical isolator 10 and thus to activate or control these in a preconfigured way. To this end, the electronic control unit 13 is preferably connected to the first semiconductor circuit configuration 11, as well as to actuating elements, particularly electromagnetic ones, of the first mechanical isolator 9 and the second mechanical isolator 10 by circuitry. The corresponding connections starting in the electronic control unit 13 are not illustrated in FIG. 1. Details about the further relevant actuation of the bypass switch 8 by the electronic control unit 13 are provided in connection with the general description of the low-voltage protective switch device 1.

The first semiconductor circuit configuration 11 preferably features a rectifier circuit 20, which is preferably designed as a full bridge, as well as, in the physical embodiment, two power semiconductors 21, which are physically designed as IGBT, as actual circuit or control elements. An embodiment with a single power semiconductor 21 can also be designed.

In FIG. 1, in addition to an actual low-voltage protective switch device 1, the electric environment is also indicated, whereby the supply network is represented by the AC/DC main power source 16, the network's internal resistance 17 and the network inductance 18. An electrical load 23 is also represented, as well as an electrical error 22 in the form of a short circuit.

The low-voltage protective switch device 1, as illustrated in FIG. 1, is designed such that a powering down is actuated by the bypass switch 8 and the first semiconductor circuit configuration 11, and the first and second isolators 9, 10 only serve to ensure galvanic isolation of the load circuit after a successful shutdown.

The physical hybrid circuit configuration 61 and a low-voltage protective switch device 1 with the latter can be designed with considerable deviations from the example provided by FIG. 1 with regards to many details. As such, in particular, multiple switching paths or external conductor segments can be planned. Furthermore, the isolators 9, 10 can be connected at other points. The first semiconductor circuit configuration 11 can be designed with other semiconductors and/or other circuitry. Moreover, additional switch elements can be planned, e.g. parallel and/or serial to the bypass switch 8.

The bypass switch 8 is designed as a switch that can be activated electromagnetically. Switches of the art are also called relays and feature at least one field coil 63. The functioning of switches or relays of the art is sufficiently known.

Figure 2:
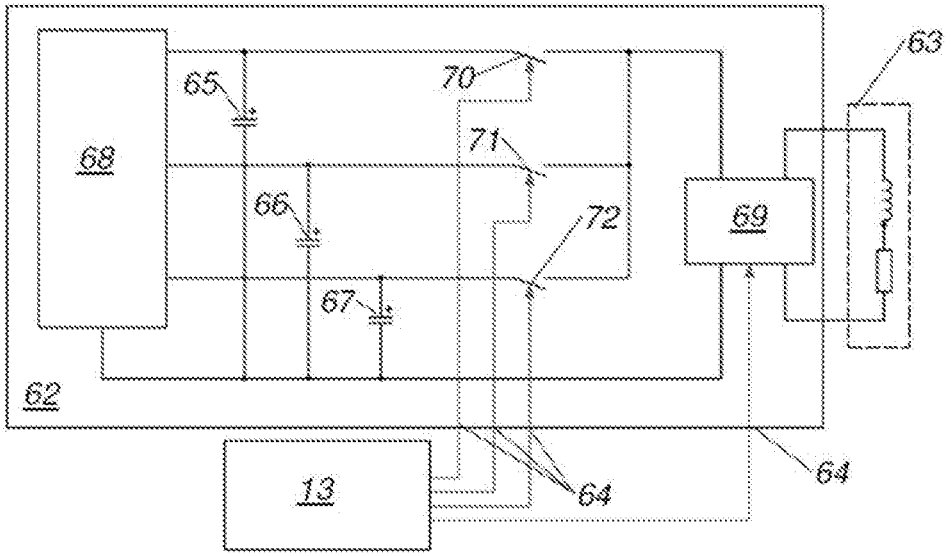
FIG. 2: a first embodiment of a bypass switch activation unit with the electronic control unit and the bypass switch field coil.
Figure 3:
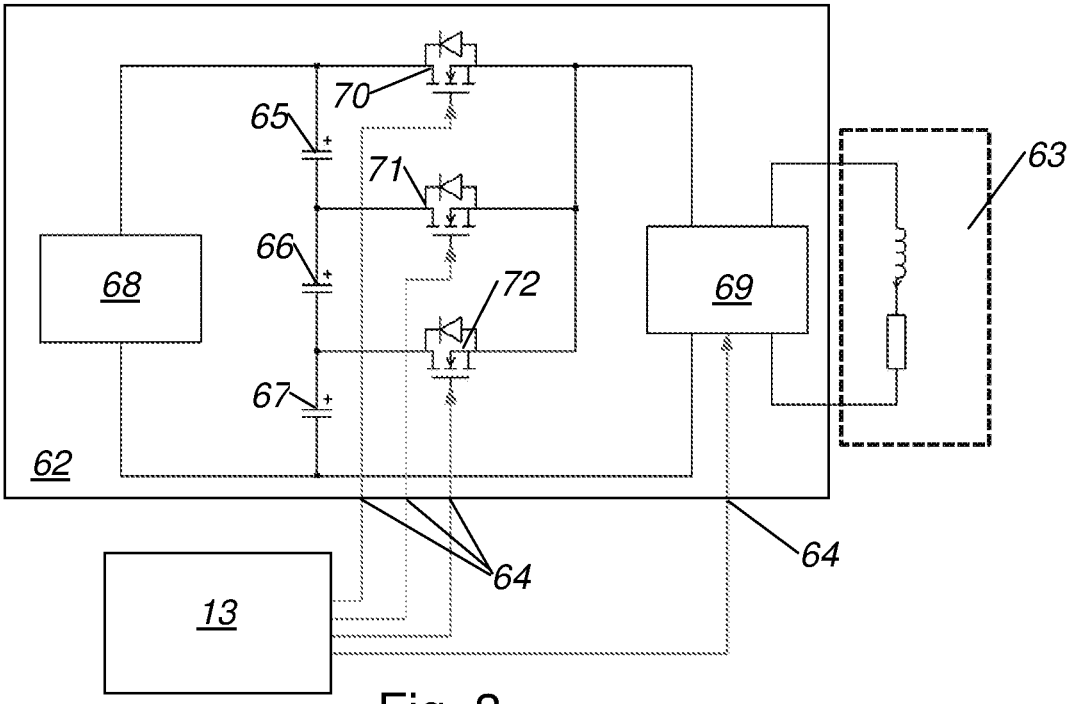
FIG. 3: a second embodiment of a bypass switch activation unit with the electronic control unit and the bypass switch field coil.
Figure 4:
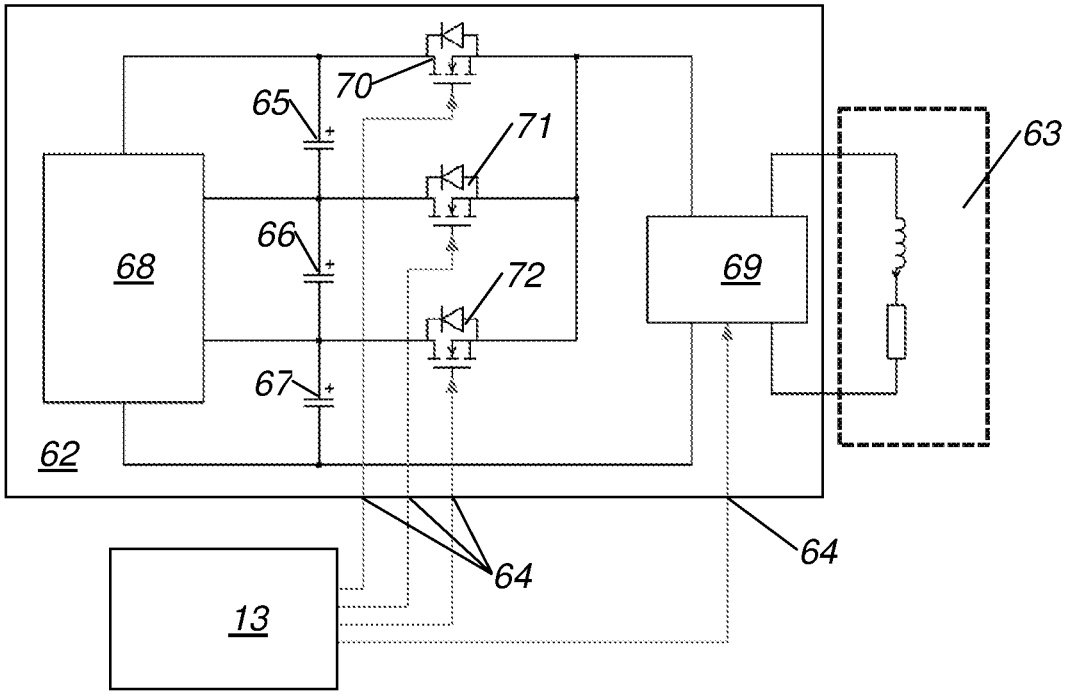
FIG. 4: a third embodiment of a bypass switch activation unit with the electronic control unit and the bypass switch field coil.

The hybrid circuit configuration features a bypass switch activation unit 62, to which bypass switch activation unit 62 at least one field coil 63 of the bypass switch 8 is connected. The bypass switch activation unit 62 features at least one control terminal 64, which is connected to the first electronic control unit 13. The corresponding connections are only schematically presented in FIG. 1. In FIGS. 2 to 4, the control terminal 64 is presented with four poles, wherein a greater or smaller number of poles can be planned, and in particular, also a ground connection.

It is planned for the electronic control unit 13 and/or the bypass switch activation unit 62 to be designed to control the field coil 63 of the bypass switch 8 in a preconfigured way either with at least one first electric current or one second electric current, wherein the second electric current is greater than the first electric current. The first, low current thereby serves for the operational switching of currents up to a nominal current of a corresponding switch device. Switch devices are always designed for a determined nominal current. The second, high current serves to power down overcurrents or short circuit currents.

The bypass switch activator unit 62 features at least two components: a power supply 68 or an energy supply unit that is always connected to the supply network or the line-side connections 3, 6 and a relay driver 69 that is designed in particular to comprise a semiconductor switch. The relay driver 69 is an actual switch that controls the field coil 63 of the bypass switch 8.

As already stated, it is preferred for the electronic control unit 13 and/or the bypass switch activation unit 62 to control the field coil 63 of the bypass switch 8 with a switching operation appropriate to the first charge, whereby the contacts of the bypass switch 8 are slowly opened, whereby in reality, an opening time of approximately 1 ms is considered slow.

Furthermore, it is preferred for a current measurement device 12 to be configured in the external conductor segment 2 and connected to the electronic control unit 13, and upon detection of a preconfigured strong current, particularly an overcurrent and/or a short circuit current, for the electronic control unit 13 and/or the bypass switch activation unit 62 to control the field coil 63 of the bypass switch 8 in the external conductor segment 2 with the second electrical charge. Very fast opening of the switch contacts of the bypass switch 8 can thereby be achieved. In this regard and in reality, an opening time of approximately 300 μs is considered very fast.

It is particularly preferred for the bypass switch activation unit 62 to be designed to control the field coil 63 of the bypass switch 8 in a preconfigured way either with at least one first electrical voltage or one second electrical voltage, whereby the second electrical voltage is greater than the first electrical voltage. The opening speed, with which the switch contacts of the bypass switch 8 are moved and opened, can safely and simply be adjusted to the respective demands through the various voltages. The first voltage can be approximately 24V, for example, while the second voltage is approximately 70V, whereby both values are real examples of the two voltage levels.

It is preferred therein for the bypass switch activation unit (62) to feature at least a first capacitor (65) and a second capacitor (66) to generate the first and/or second charge. More capacitors can be planned, of course, e.g. a third capacitor 67. The concerned capacitors 65, 66, 67 can be set in various configurations to generate the various energy levels.

FIG. 2 shows a first embodiment of a bypass switch activation unit 62. This is connected to the electronic control unit 13 on the input and control sides, wherein an output of the bypass switch activation unit 62 is joined to the field coil 63 of the bypass switch 8 or connected to it. The field coil 63 is illustrated in FIGS. 2 to 4 by their inductances and their inner resistances. No further components of the bypass switch 8 are illustrated in FIGS. 2 to 4 except the field coil 63.

According to the first embodiment, the bypass switch activation unit (62) features three capacitors 65, 66, 67 that can each be activated using a separate switch 70, 71, 72 individually or in combination with the relay driver 69. Thus, various energy levels can easily be generated. The switches 70, 71, 72 can be designed as desired, e.g. also as semiconductor switches.

FIG. 3. shows a second embodiment of a bypass switch activation unit 62 also featuring three capacitors 65, 66, 67 creating a voltage divider. The switches 70, 71, 72 are thereby designed as semiconductor switches.

FIG. 4. shows a third embodiment of a bypass switch activation unit 62 also featuring three capacitors 65, 66, 67. The switches 70, 71, 72 are again designed as semiconductor switches. Through wiring according to FIG. 4, an individual adjustment of the voltages is possible for each capacitor 65, 66, 67.

According to a further embodiment, it is planned for the electronic control unit 13 and/or the bypass switch activation unit 62 to be designed to control the field coil 63 of the bypass switch 8 in a preconfigured way either for at least a first length of time or a second length of time, wherein the second length of time is greater than the first length of time. It is therefore also planned, alternatively or in addition to the adjustment of the voltage, to adjust the length of time during which a voltage affects the field coil 63. It is thus also possible and planned to influence the opening speed of the relay contacts.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A hybrid circuit configuration, particularly a protection circuit configuration, comprising:

at least one first external conductor segment;

a first mechanical bypass switch provided in the first external conductor segment;

a first semiconductor switch configuration connected in parallel to the first bypass switch;

a first electronic control unit configured to activate the first semiconductor switch configuration; and a bypass switch activation unit, to which bypass switch activation unit at least one field coil of the bypass switch is connected, the bypass switch activation unit comprising a relay driver, a first capacitor connected to a first switch, a second capacitor connected to a second switch, and a third capacitor connected to a third switch, each capacitor being activatable using its respective switch individually or in combination with the relay driver, wherein at least one control terminal of the bypass switch activation unit is connected to the first electronic control unit, and wherein the electronic control unit and/or the bypass switch activation unit is configured to control the at least one field coil of the bypass switch in a preconfigured way either with at least one first electric current or at least one second electric current, the at least one second electric current being greater than the at least one first electric current.

2. The hybrid circuit configuration according to claim 1, wherein the bypass switch activation unit is configured to control the at least one field coil of the bypass switch in a preconfigured way either with the at least one first electric current or the at least one second electric current, the one second electric current being greater than the at least one first electric current.

3. The hybrid circuit configuration according to claim 1, wherein the electronic control unit and/or the bypass switch activation unit is configured to control the at least one field coil of the bypass switch in a preconfigured way either for at least a first length of time or a second length of time, the second length of time being greater than the first length of time.

4. The hybrid circuit configuration according to claim 1, wherein the bypass switch activation unit comprises at least a first capacitor and a second capacitor configured to generate the at least one first electric current and/or the at least one second electric current.

5. The hybrid circuit configuration according to claim 1, wherein the electronic control unit and/or the bypass switch activation unit is configured to control the at least one field coil of the bypass switch with a switching operation appropriate to the at least one first electric current.

6. The hybrid circuit configuration according to claim 1, further comprising a current measurement unit in the first external conductor segment, which current measurement unit is connected to the electronic control unit, wherein, upon detection of a predetermined current, the electronic control unit and/or the bypass switch activation unit is configured to control the at least one field coil of the bypass switch in the external conductor segment with the at least one second electric current.

7. A low-voltage protective switch device, comprising:

the hybrid circuit configuration according to claim 1.

8. The hybrid circuit configuration according to claim 6, wherein the predetermined current comprises a strong current.

9. The hybrid circuit configuration according to claim 8, wherein the strong current comprises an overcurrent and/or a short circuit current.

* * * * *